US012780526B2

(12) United States Patent
Searle

(10) Patent No.: US 12,780,526 B2
(45) Date of Patent: Nov. 3, 2026

(54) SEALED SHIPPING BOX HAVING PANELS WITH VACUUM RETENTION MECHANISMS

(71) Applicant: GSTC LLC, Scottsdale, AZ (US)

(72) Inventor: Gideon P. Searle, Scottsdale, AZ (US)

(73) Assignee: GSTC LLC, Scottsdale, AZ (US)

( * ) Notice: Subject to any disclaimer, the term of this patent is extended or adjusted under 35 U.S.C. 154(b) by 0 days.

(21) Appl. No.: 19/085,406

(22) Filed: Mar. 20, 2025

(65) Prior Publication Data

US 2025/0313397 A1 Oct. 9, 2025

Related U.S. Application Data

(60) Provisional application No. 63/573,859, filed on Apr. 3, 2024.

(51) Int. Cl.
*B65D 81/20* (2006.01)
*A45C 13/10* (2006.01)

(52) U.S. Cl.
CPC ..... *B65D 81/2038* (2013.01); *A45C 13/103* (2013.01); *B65D 2203/10* (2013.01)

(58) Field of Classification Search
CPC ..... B65D 81/2038; B65D 81/2015; B65D 81/2007; B65D 81/20; B65D 81/00; B65D 81/2023; B65D 81/03; A45C 13/103; A45C 13/1023; A45C 3/00; A45C 3/001

See application file for complete search history.

(56) References Cited

U.S. PATENT DOCUMENTS

| | | | | | |
|---|---|---|---|---|---|
| 6,135,277 | A * | 10/2000 | Armstrong | A47F 3/005 | 206/45.24 |
| 8,387,789 | B2 * | 3/2013 | Baker | B65D 81/03 | 206/521 |
| 9,834,361 | B2 * | 12/2017 | Baker | B65D 81/03 | |
| 12,507,777 | B2 * | 12/2025 | Dooling | A45C 13/008 | |
| 2023/0192382 | A1 * | 6/2023 | Searle | B65D 81/052 | 206/522 |
| 2023/0243619 | A1 * | 8/2023 | Searle | B65D 43/0214 | 206/522 |

* cited by examiner

*Primary Examiner* — Javier A Pagan
(74) *Attorney, Agent, or Firm* — Neo IP

(57) ABSTRACT

A shipping box includes side panels lined with zipper mechanisms operable to interlock to seal the box and any objects within the box. The side panels are filled with microbeads or other small packaging material and at least one of the side panels includes a valve. The valve, when actuated, allows for withdrawal of air from the side panels using a vacuum pump, causing the microbeads to compactify around the contents of the shipping box.

20 Claims, 3 Drawing Sheets

SEALED SHIPPING BOX HAVING PANELS WITH VACUUM RETENTION MECHANISMS

CROSS-REFERENCE TO RELATED APPLICATIONS

This application is related to and claims priority from the following US patents and patent applications: this application claims priority from and the benefit of U.S. Provisional Patent Application No. 63/573,859, filed Apr. 3, 2024, which is incorporated herein by reference in its entirety.

BACKGROUND OF THE INVENTION

1. Field of the Invention

The present invention relates to shipping boxes, and more specifically to shipping boxes having vacuum retention systems integrated into side panels of the box.

2. Description of the Prior Art

It is generally known in the prior art to provide shipping boxes and to fill the interior of such shipping boxes with various forms of packaging material.

Prior art patent documents include the following:

US Patent Pub. No. 2023/0243619 for Composite case having retaining bag including bead refill mechanism by inventors Searle et al., filed Feb. 21, 2023 and published Aug. 3, 2023, discloses a protective carrying case for a firearm, wherein the protective carrying case includes a top component, a bottom component, and semi-hexagonal ends, wherein the top component and the bottom component are constructed from carbon fiber. The protective carrying case additionally includes a retaining element with vacuum split functionality to retain elements within the case.

U.S. Pat. No. 6,135,277 for Composite case having retaining bag including bead refill mechanism by inventor Armstrong, filed Apr. 10, 1998 and issued Oct. 24, 2000, discloses a portable airtight inner case includes a receptacle for having an item stored therein, for example a guitar, a hingedly mounted cover and a perimetric seal to form a fluid seal between the cover and receptacle when the cover is closed. The inner case cover and receptacle are made of a clear rigid plastic. A suction valve or pump opens to the inner case interior to evacuate fluid while a vacuum gauge is provided for measuring the pressure. The inner case bottom wall has a plurality of pockets for having hangers extended therein to hang the case on a wall and stand pockets to have stand parts of a foldable stand extended therein or a stand pivoted to the bottom wall to support the inner case in an inclined condition. A portable outer case has a compartment for containing the inner case.

SUMMARY OF THE INVENTION

The present invention relates to shipping boxes, and more specifically to shipping boxes having vacuum retention systems integrated into side panels of the box.

It is an object of this invention to provide reusable shipping boxes using microbeads and a vacuum evacuation mechanism to firmly retain the contents of the boxes.

In one embodiment, the present invention is directed to a shipping box, including a central panel, and a plurality of vacuum retention panels, wherein the central panel and/or the plurality of vacuum retention panels includes at least one interior chamber, wherein the at least one interior chamber includes microbeads, wherein each of the plurality of vacuum retention panels includes a zipper along at least one edge, wherein at least one of the plurality of vacuum retention panels and/or the central panel includes at least one valve extending through the at least one of the plurality of retention panels and/or the central panel, and wherein the zipper is operable to connect the at least one edge of each of the plurality of vacuum retention panels.

In another embodiment, the present invention is directed to a shipping box, including a central panel, and a plurality of vacuum retention panels, wherein the central panel and/or the plurality of vacuum retention panels includes at least one interior chamber, wherein the at least one interior chamber includes microbeads, wherein the central panel and/or the plurality of vacuum retention panels are separated from the at least one interior chamber via at least one weld, wherein each of the plurality of vacuum retention panels includes a zipper along at least one edge, wherein at least one of the plurality of vacuum retention panels and/or the central panel includes at least one valve extending through the at least one of the plurality of retention panels and/or the central panel, and wherein the zipper is operable to connect the at least one edge of each of the plurality of vacuum retention panels.

In yet another embodiment, the present invention is directed to a shipping box, including a central panel, and a plurality of vacuum retention panels, wherein the central panel and/or the plurality of vacuum retention panels includes at least one interior chamber, wherein the at least one interior chamber includes at least one air-porous tube, wherein the at least one interior chamber includes microbeads, wherein each of the plurality of vacuum retention panels includes a zipper along at least one edge, wherein at least one of the plurality of vacuum retention panels and/or the central panel includes at least one valve extending through the at least one of the plurality of retention panels and/or the central panel, and wherein the zipper is operable to connect the at least one edge of each of the plurality of vacuum retention panels.

These and other aspects of the present invention will become apparent to those skilled in the art after a reading of the following description of the preferred embodiment when considered with the drawings, as they support the claimed invention.

DETAILED DESCRIPTION

Figure 1A:
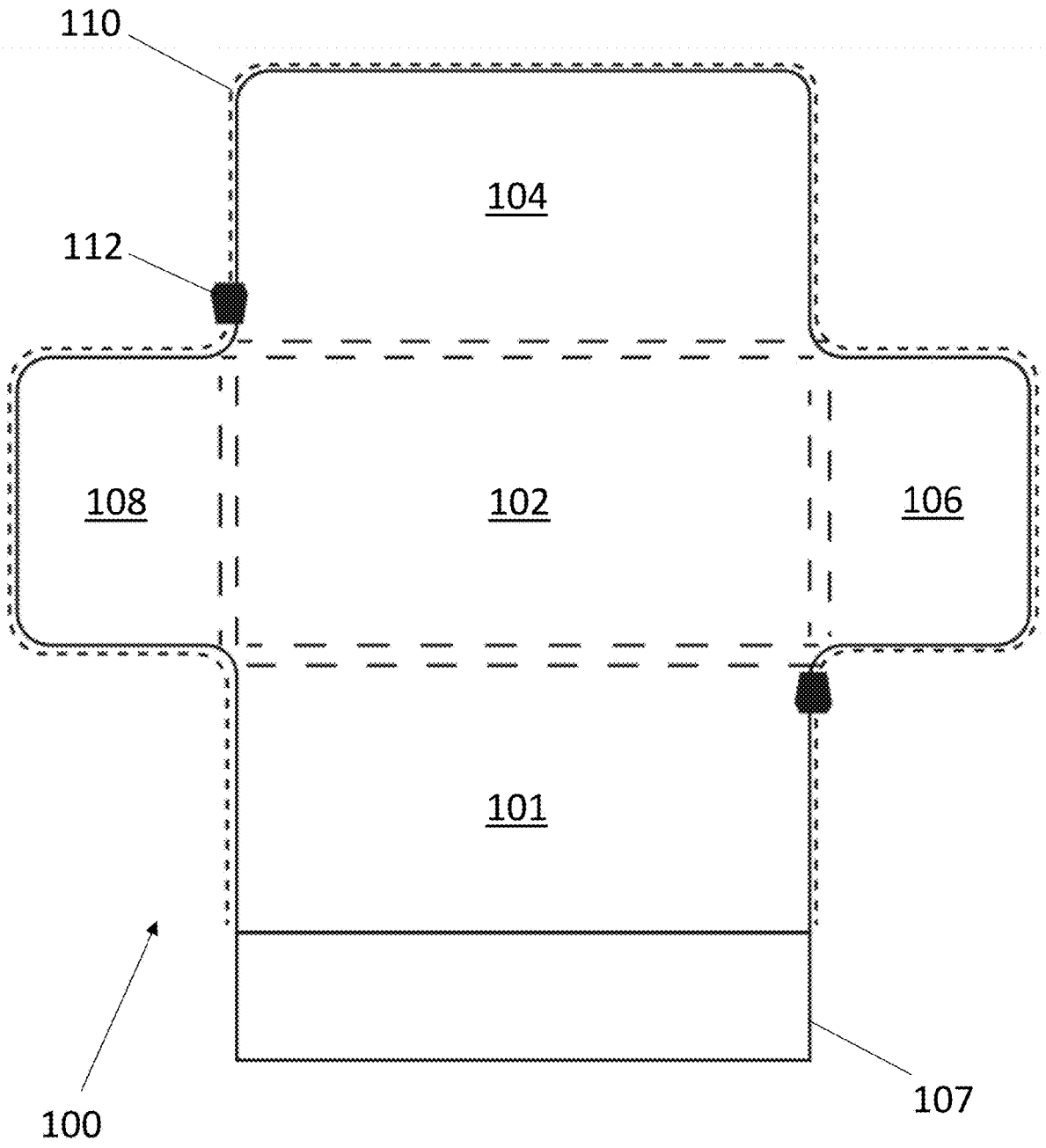
FIG. 1A illustrates a deconstructed shipping box including vacuum retention panels and a zipper close mechanism according to one embodiment of the present invention.

The present invention is generally directed to shipping boxes, and more specifically to shipping boxes having vacuum retention systems integrated into side panels of the box.

In one embodiment, the present invention is directed to a shipping box, including a central panel, and a plurality of vacuum retention panels, wherein the central panel and/or the plurality of vacuum retention panels includes at least one interior chamber, wherein the at least one interior chamber includes microbeads, wherein each of the plurality of vacuum retention panels includes a zipper along at least one edge, wherein at least one of the plurality of vacuum retention panels and/or the central panel includes at least one valve extending through the at least one of the plurality of retention panels and/or the central panel, and wherein the zipper is operable to connect the at least one edge of each of the plurality of vacuum retention panels.

In another embodiment, the present invention is directed to a shipping box, including a central panel, and a plurality of vacuum retention panels, wherein the central panel and/or the plurality of vacuum retention panels includes at least one interior chamber, wherein the at least one interior chamber includes microbeads, wherein the central panel and/or the plurality of vacuum retention panels are separated from the at least one interior chamber via at least one weld, wherein each of the plurality of vacuum retention panels includes a zipper along at least one edge, wherein at least one of the plurality of vacuum retention panels and/or the central panel includes at least one valve extending through the at least one of the plurality of retention panels and/or the central panel, and wherein the zipper is operable to connect the at least one edge of each of the plurality of vacuum retention panels.

In yet another embodiment, the present invention is directed to a shipping box, including a central panel, and a plurality of vacuum retention panels, wherein the central panel and/or the plurality of vacuum retention panels includes at least one interior chamber, wherein the at least one interior chamber includes at least one air-porous tube, wherein the at least one interior chamber includes microbeads, wherein each of the plurality of vacuum retention panels includes a zipper along at least one edge, wherein at least one of the plurality of vacuum retention panels and/or the central panel includes at least one valve extending through the at least one of the plurality of retention panels and/or the central panel, and wherein the zipper is operable to connect the at least one edge of each of the plurality of vacuum retention panels.

As the number of packages shipped continue to increase with increasing population and increased reliance on online shopping over traditional retail stores, the amount of packaging waste correspondingly increases. Much of this packaging waste is recyclable, being based on cardboard, paperboard, or even recyclable polymers such as polypropylene or polyethylene. However, even the use of recyclable materials incurs increased energy or material costs, albeit less than non-recyclable options. Furthermore, other parts of the packaging, such as packaging fill materials are either unable to be recycled or have notably decreased recycling compliance.

One way to further reduce waste is to utilize reusable packages, but even reusable packages often require new packaging material and stuffing to be utilized to ensure the package is properly retained. Furthermore, using more uniform reusable packages creates its own difficulties, as the standardized sizes are less likely to properly fit and retain different sizes of packages without additional stuffing. Therefore, what is needed, to reduce waste and reduce cost for shippers, is to provide reusable & sustainable containers capable of more reliably conforming to the size or shape of the contents of the package.

Referring now to the drawings in general, the illustrations are for the purpose of describing one or more preferred embodiments of the invention and are not intended to limit the invention thereto.

Figure 1B:
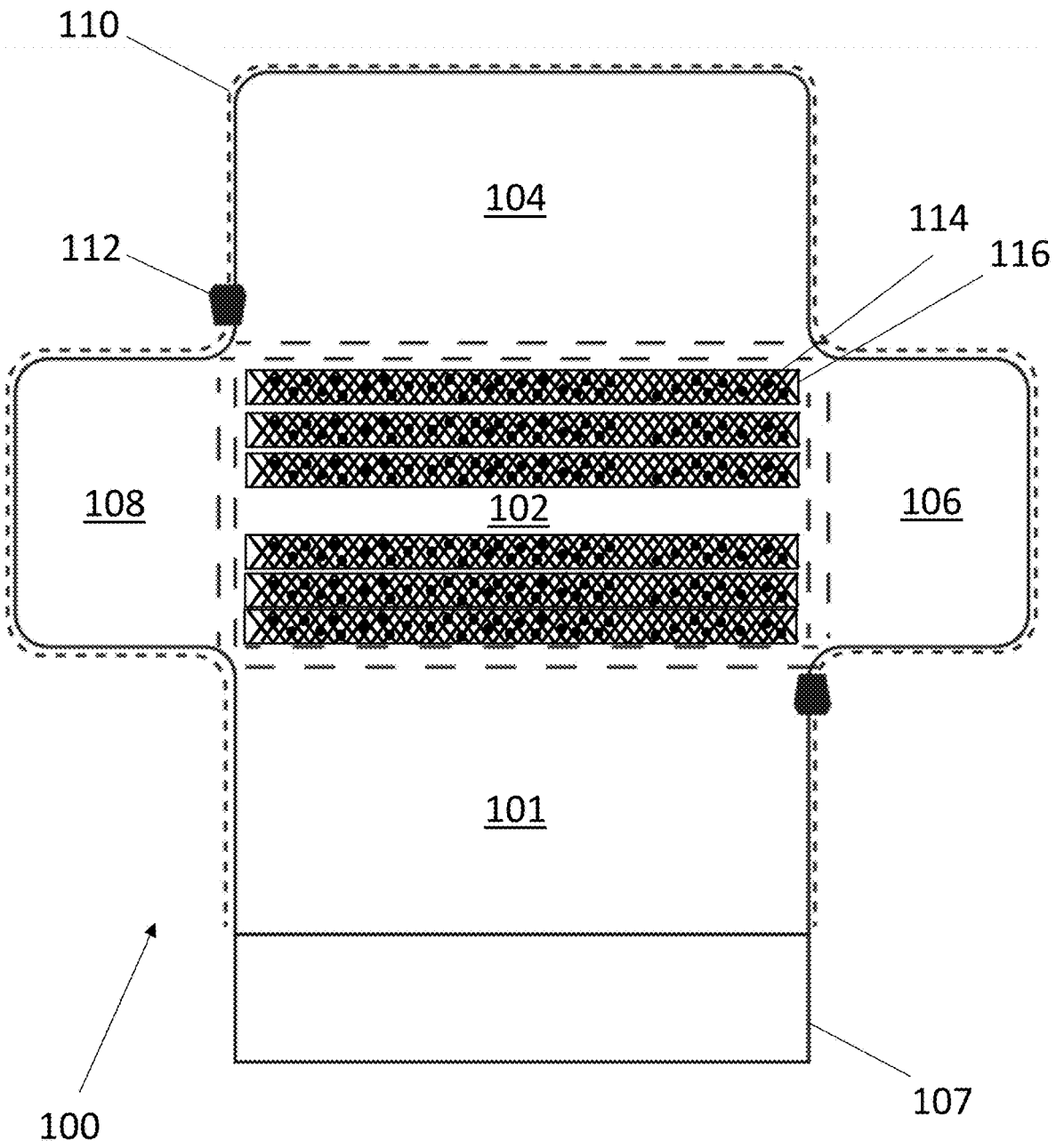
FIG. 1B illustrates a deconstructed shipping box including vacuum retention panels and a zipper close mechanism according to one embodiment of the present invention.

FIGS. 1A and 1B illustrates a deconstructed shipping box including vacuum retention panels and a zipper close mechanism according to one embodiment of the present invention. The shipping box 100 includes a central panel 102. A first side panel 106 extends from a right side of the central panel 102 and a second side panel 108 extends from a left side of the central panel 102. A front panel 104 extends from a front side of the central panel 102 and a back panel 101 extends from a rear side of the central panel 102. A bottom panel 107 extends from a side of the back panel 101 opposite from the side of the back panel 101 connected to the central panel 102. One of ordinary skill in the art will understand that the relative dimensions shown in FIG. 1A are not intended to be limiting according to the present invention.

In one embodiment, the central panel 102 and the bottom panel 107 have approximately the same length and width. In one embodiment, the back panel 101 and the front panel 104 have approximately the same length and width. In one embodiment, the first side panel 106 and the second side panel 108 have approximately the same length and width.

In a preferred embodiment, the outer edges of the first side panel 106 and the second side panel 108, except those edges connected to the central panel 102, are lined with zipper teeth 110. In a preferred embodiment, the outer edges of the front panel 104, except the edge connected to the central panel 102, are lined with zipper teeth 110. In a preferred embodiment, the outer edges of the back panel 101, except those edges connected to the central panel 102 and the bottom panel 107, are lined with zipper teeth 110. In a preferred embodiment, the outer edges of the bottom panel 107, except the edge connected to the back panel 101, are lined with zipper teeth 110. In a preferred embodiment, the zipper teeth 110 lining the first side panel 106, the second side panel 108, front panel 104, the back panel 101, the bottom panel 107, and any combinations or subcombinations thereof form a single zipper mechanism operable to be closed by one or more pull tabs 112. In one embodiment, in addition to or in lieu of the zipper mechanism, the shipping box 100 is able to be constructed and closed by one or more other mechanisms (e.g., via hook and loop strips on the edges of the panels, via one or more removable adhesives, etc.).

In one embodiment, the central panel 102 includes an interior chamber with a plurality of microbeads included therein. In one embodiment, the first side panel 106 includes an interior chamber with a plurality of microbeads included therein. In one embodiment, the second side panel 108 includes an interior chamber with a plurality of microbeads included therein. In one embodiment, the front panel 104 includes an interior chamber with a plurality of microbeads included therein. In one embodiment, the bottom panel 107 includes an interior chamber with a plurality of microbeads included therein. In one embodiment, the first side panel 106 includes an interior chamber with a plurality of microbeads included therein. In one embodiment, the microbeads are formed from rubber, polystyrene, and/or expanded polypropylene (EPP). Microbeads used according to the present invention are able to be replaced with other suitable shapes or types of packaging filling as necessary.

In one embodiment, the interior chamber of the central panel 102 is separated from the interior chamber of the first side panel 106 by at least one weld, preventing beads from moving between the two interior chambers. The welds thereby act as baffles between the interior chambers of the panels. In one embodiment, the interior chamber of the central panel 102 is separated from the interior chamber of the second side panel 108 by at least one weld, preventing beads from moving between the two interior chambers. In one embodiment, the interior chamber of the central panel 102 is separated from the interior chamber of the front panel 104 by at least one weld, preventing beads from moving between the two interior chambers. In one embodiment, the interior chamber of the central panel 102 is separated from the interior chamber of the back panel 101 by at least one weld, preventing beads from moving between the two interior chambers. In one embodiment, the interior chamber of the bottom panel 107 is separated from the interior chamber of the back panel 101 by at least one weld, preventing beads from moving between the two interior chambers. The separation of the panels via the welds helps prevent beads from accumulating only on certain sides of the package.

In one embodiment, one or more of the panels are filled with microbeads in an unstructured manner (i.e., the beads are loose within the interior chamber of the panels). However, in another embodiment, shown in FIG. 1B, the microbeads 114 are contained within air-porous tubes 116 fixed within the panels and running horizontally and/or vertically within the panels. This prevents all the microbeads 114 from settling to the bottom of one or more of the panels, and allows the general shape of the shipping box 100 to be maintained over time.

In one embodiment, not all of the panels of the shipping box 100 include interior chambers filled with microbeads. By way of example and not limitation, in one embodiment, only the central panel 102 and the bottom panel 107 have interior chambers filled with microbeads, while the front panel 104, the back panel 101, the first side panel 106, and/or the second side panel 108 are formed from a rigid polymer material (e.g., polypropylene, high-density polyethylene (HDPE), polystyrene, polycarbonate, EPP boards, etc.), cardboard, a fiber-reinforced polymer (e.g., fiberglass, carbon fiber, etc.), and/or one or more other rigid materials. In one embodiment, an interior surface of one or more panels is covered with a soft material (e.g., felt) for softer treatment of the packaged material.

Figure 2:
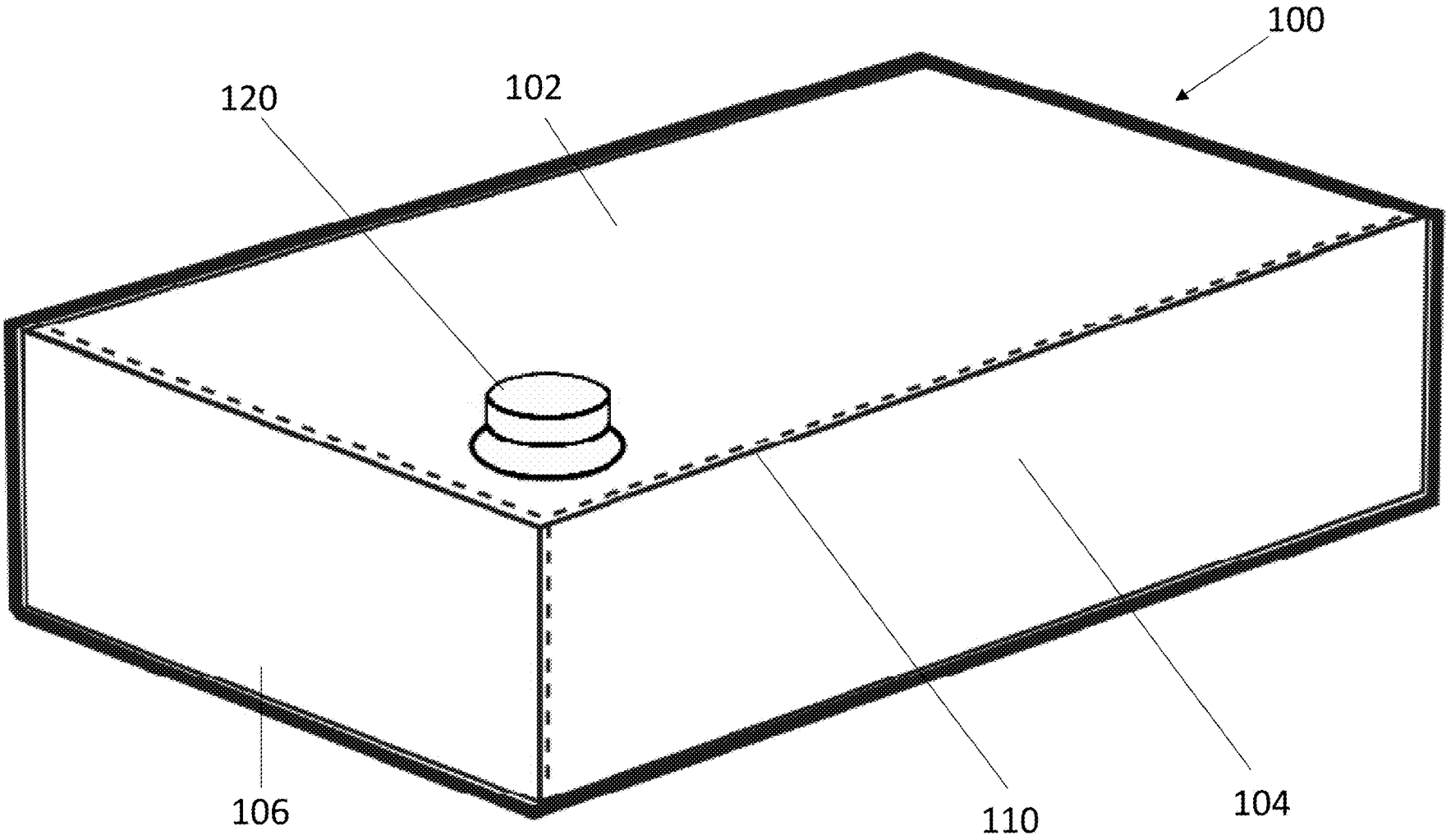
FIG. 2 illustrates a closed shipping box including vacuum retention panels according to one embodiment of the present invention.

FIG. 2 illustrates a closed shipping box including vacuum retention panels according to one embodiment of the present invention. In one embodiment, after being zipped together (or otherwise joined), the resulting container is shaped like a rectangular prism. In this embodiment, after being put together, the front panel 102 is substantially parallel to the bottom panel, the front panel 104 is substantially parallel to the back panel, and the first side panel 106 is substantially parallel to the second side panel. In one embodiment, each of the pairs of substantially parallel panels is substantially orthogonal to each of the other pairs of substantially parallel panels. One of ordinary skill in the art will understand that the invention according to the present invention is not limited to the relative dimensions shown in FIG. 2, and in other embodiments, each of the panels has approximately the same length and width (making the container a cube), or different dimensions.

In one embodiment, at least one valve 120 extends through one or more of the panels (e.g., the front panel 102, as shown in FIG. 2). The at least one valve 120 is configured to be attached to at least one vacuum pump, which is configured to pull air out of the panel, thereby causing the microbeads or other packaging material within the panel to compactify and solidify around the contents of the shipping box 100. In one embodiment, the welds between each panel are configured to be porous to air, but not to the microbeads within each panel. In this embodiment, the use of a single valve connected to a single panel is able to evacuate air from multiple of the panels, or even all the panels. In another embodiment, however, the welds are not porous to air and each panel has its own valve 120 operable to evacuate air from that panel. In one embodiment, the at least one valve includes an internal filter or grating sized and configured to prevent microbeads from escaping during the air evacuation process, but still allowing air to escape.

In one embodiment, the at least one valve 120 exists in at least two states, including an open state and a closed state. In a closed state, air is unable to enter or be evacuated from the at least one valve 120. In an open state, air is able to enter or be evacuated from the panel. However, if the vacuum pump is connected when the at least one valve 120 is in the open state, no air is able to enter the panel, instead only allowing air to be withdrawn. However, when the vacuum pump is not connected to the at least one valve 120 in the open state, air is able to reenter and fill the panel.

The design of the present invention allows it to be easily reused, as after an individual receives the package and unzips it to find the contents, the package is able to be easily rezipped to contain a new product. Additionally, if the at least one valve 120 is then opened to allow air back in and then the air is re-evacuated once the shipping box 100 is again constructed with the new contents in side, the size of the shipping box 100 is effectively able to adapt to the size and shape of the new contents due to the microbead compactification.

In one embodiment, the zipper mechanism, or other sealing mechanisms, on the shipping box 100 includes an integrated code lock, or other locking, mechanism for improved security. In this embodiment, the recipient of the message is able to receive the code (e.g., via text message, separate physical mail, via email, etc.), thereby reducing the risk of mail tampering and ensuring only the recipient is able to open the shipping box 100.

In one embodiment, the shipping box 100 includes one or more embedded GPS chips and/or other geolocation identifying chips, thereby allowing for easier tracking and accountability of the package. In one embodiment, a software platform includes a graphical user interface (GUI) operable to track the one or more embedded GPS chips, providing an indication of a geolocation transmitted via a network and/or a time at which the geolocation information was last updated. In one embodiment, the shipping box 100 includes at least radiofrequency identification (RFID) and/or near-field communication (NFC) chip able to be uniquely identified by the recipient or by other components of the shipping and delivery system to ensure that the correct package is being delivered. In one embodiment, scanning the RFID chip or NFC chip with at least one network enabled device automatically updates a distributed ledger entry associated with the chip (e.g., creates a new block) with a geolocation and/or scanning device ID. In this embodiment, the RFID chip or NFC chip is preferably replaced before reuse to prevent access to log history of previous deliveries when tracking a later one.

In one embodiment, the shipping box 100 includes at least one integrated screen (e.g., an LED screen). In one embodiment, the shipping box 100 includes at least one battery and/or at least one photovoltaic cell for providing energy for the at least one integrated screen. The integrated screen is operable to display information regarding the recipient (e.g., an individual's name, an address, etc.), information regarding the sender (e.g., an individual's name, an address, etc.), and/or other label slip information. Use of the integrated screen allows for different label slips to be included on the package without the need for separate label slips or for adhesive to be used for these label slips.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the present invention.

The invention claimed is:

1. A shipping box, comprising:

a central panel; and a plurality of vacuum retention panels;

wherein the central panel and/or the plurality of vacuum retention panels includes at least one interior chamber;

wherein the at least one interior chamber includes microbeads;

wherein each of the plurality of vacuum retention panels includes a zipper along at least one edge;

wherein at least one of the plurality of vacuum retention panels and/or the central panel includes at least one valve extending through the at least one of the plurality of retention panels and/or the central panel; and wherein the zipper is operable to connect the at least one edge of each of the plurality of vacuum retention panels.

2. The shipping box of claim 1, wherein at least two of the plurality of vacuum retention panels include approximately equal length and width.

3. The shipping box of claim 1, wherein the microbeads include rubber, polystyrene, and/or expanded polypropylene (EPP).

4. The shipping box of claim 1, wherein the central panel and/or the plurality of vacuum retention panels are separated from the at least one interior chamber via at least one weld.

5. The shipping box of claim 1, wherein connecting the at least one edge of each of the plurality of vacuum retention panels forms a rectangular prism.

6. The shipping box of claim 1, wherein the at least one valve is operable to attach to at least one vacuum pump.

7. The shipping box of claim 6, wherein the at least one vacuum pump is operable to pull air out of the at least one interior chamber, thereby solidifying the microbeads.

8. The shipping box of claim 1, further comprising at least one embedded global positioning system (GPS) chip.

9. A shipping box, comprising:

a central panel; and a plurality of vacuum retention panels;

wherein the central panel and/or the plurality of vacuum retention panels includes at least one interior chamber;

wherein the at least one interior chamber includes microbeads;

wherein the central panel and/or the plurality of vacuum retention panels are separated from the at least one interior chamber via at least one weld;

wherein each of the plurality of vacuum retention panels includes a zipper along at least one edge;

wherein at least one of the plurality of vacuum retention panels and/or the central panel includes at least one valve extending through the at least one of the plurality of retention panels and/or the central panel; and wherein the zipper is operable to connect the at least one edge of each of the plurality of vacuum retention panels.

10. The shipping box of claim 9, wherein at least two of the plurality of vacuum retention panels include approximately equal length and width.

11. The shipping box of claim 9, wherein the microbeads include rubber, polystyrene, and/or expanded polypropylene (EPP).

12. The shipping box of claim 9, wherein connecting the at least one edge of each of the plurality of vacuum retention panels forms a rectangular prism.

13. The shipping box of claim 9, wherein the at least one valve is operable to attach to at least one vacuum pump.

14. The shipping box of claim 13, wherein the at least one vacuum pump is operable to pull air out of the at least one interior chamber, thereby solidifying the microbeads.

15. The shipping box of claim 9, further comprising at least one embedded global positioning system (GPS) chip.

16. The shipping box of claim 9, wherein the at least one interior chamber includes at least one air-porous tube.

17. A shipping box, comprising:

a central panel; and a plurality of vacuum retention panels;

wherein the central panel and/or the plurality of vacuum retention panels includes at least one interior chamber;

wherein the at least one interior chamber includes at least one air-porous tube;

wherein the at least one interior chamber includes microbeads;

wherein each of the plurality of vacuum retention panels includes a zipper along at least one edge;

wherein at least one of the plurality of vacuum retention panels and/or the central panel includes at least one valve extending through the at least one of the plurality of retention panels and/or the central panel; and wherein the zipper is operable to connect the at least one edge of each of the plurality of vacuum retention panels.

18. The shipping box of claim 17, wherein the at least one valve is operable to attach to at least one vacuum pump.

19. The shipping box of claim 17, wherein the central panel and/or the plurality of vacuum retention panels are separated from the at least one interior chamber via at least one weld.

20. The shipping box of claim 17, further comprising at least one embedded global positioning system (GPS) chip.

* * * * *